US006006519A

United States Patent [19]

Hormell, Jr.

[11] Patent Number: 6,006,519

[45] Date of Patent: Dec. 28, 1999

[54] COMPRESSED AIR-POWERED ENGINE

[76] Inventor: Jack V. Hormell, Jr., P.O. Box 546, Moncks Corner, S.C. 29461

[21] Appl. No.: 08/986,367

[22] Filed: Dec. 8, 1997

[51] Int. Cl.[6] ..... F16D 31/02

[52] U.S. Cl. ..... 60/407; 418/61.2

[58] Field of Search ..... 60/407; 418/61.2

[56] References Cited

U.S. PATENT DOCUMENTS 4,292,804 10/1981 Rogers, Sr. ..... 60/407
4,386,890 6/1983 Berkowitz ..... 418/61.2
4,487,561 12/1984 Eiermann ..... 418/61.2
5,251,596 10/1993 Westland ..... 418/61.2 X
5,515,675 5/1996 Bindschatel ..... 60/407 X

*Primary Examiner*—Hoang Nguyen

[57] ABSTRACT

An internal combustion engine is disclosed that runs efficiently on compressed air supplied by air compressors. The preferred power plant for the instant invention air powered engine is the Wankel-type rotary engine. The air compressors which supply the air "fuel" to the engine chamber where the air is re-compressed to provide the force for "pushing" the rotors within the chamber which rotational movement provides the power to turn the drive shaft. These air compressors may be electrically and/or mechanically driven.

7 Claims, 3 Drawing Sheets

COMPRESSED AIR-POWERED ENGINE

BACKGROUND OF THE INVENTION

1. Field of the Invention

This invention relates generally to compressed air engines. Particularly, it relates to such an engine capable of maintaining the pressure in its supply tank at a predetermined level for efficient and continuous operation. More particularly, one embodiment of the instant invention relates to an adaptation of the Wankel-type rotary engine which adaptation enhances engine efficiency for using compressed air as its force of propulsion.

2. Description of Related Art (Including Information Disclosed Under 37 CFR 1.97 and 1.98)

In spite of their many benefits, internal combustion engines for powering motor vehicles and fossil fuel burning plants used in energy producing operations throughout the industrialized nations have been under attack for many years because of their inherent characteristics which produce air and other pollutants. This is due, of course, to the nature and required volumes of the fossil fuel needed to produce the necessary power for the various uses to which the engines are put, not the inherent design of the engine itself. Much research has been devoted to increase the combustion efficiency and filter the exhaust from these power plants with a view to "saving" the atmosphere through more efficient and cleaner burning. In particular, various steps have been taken by the automotive industry to reduce fuel consumption by automobiles. For example, computer monitoring of internal combustion engine functions and fuel flow has resulted in the production of a more complete combustion of the air fuel mixture after it enters the combustion chamber of the internal combustion engine. Once the gas is burned and subsequently exhausted, it is then filtered through a catalytic converter which removes additional pollutants before the exhaust is expelled into the atmosphere. The relative successes of such operations, however, have been incrementally slow and limited.

One of the approaches taken in the production of a completely clean power plant is the design of an air powered engine which is, of course, completely pollution free, since there are absolutely no combustion gasses generated and released into the atmosphere. However, design in this area has been somewhat limited because of the reduced power output capable for such engines and because of their somewhat inefficient and complex operations. The air engine, therefore, has seen only limited use in some cases as an auxiliary power plant with a combustion engine as the primary power source, or more often it has been abandoned entirely in favor of other systems because of the auxiliary power needed to maintain an adequate supply of air pressure for the system.

Various attempts to successfully develop commercial air engines include:

| U.S. Pat. No. | Title |
|---|---|
| 3,765,180 | Compressed Air Engine |
| 3,925,984 | Compressed Air Power Plant |
| 4,102,130 | Converting An Internal Combustion Engine to a Single Acting Engine Driven by Steam or Compressed Air |
| 4,104,955 | Compressed Air-Operated Motor Employing an Air Distributor |
| 4,124,978 | Compressed Air Engine |

-continued

| U.S. Pat. No. | Title |
|---|---|
| 4,311,084 | Pneumatic Engine |
| 4,370,857 | Pneumatic System for Compressed Air Driven Vehicle |
| 4,478,304 | Compressed Air Power Engine |
| 4,590,767 | Hot Gas Engine and Vehicle Driven System |
| 4,596,119 | Compressed Air Propulsion System for a Vehicle |
| 4,651,525 | Piston Reciprocating Compressed Air Engine |
| 5,154,051 | Air Liquefier and Separator of Air Constituents for a Liquid |
| 5,491,977 | Engine Using Compressed Air |
| 5,638,681 | Piston Internal-Combustion Engine |
| 5,680,764 | Clean Air Engines Transportation and Other Power Applications |

The devices described by the above-recited patents fall far short of commercial practicality. If they are pollution-free they are too complicated, and, if simple, they are not pollution-free.

Therefore, it is an object of this invention to provide a relatively simple, efficient non-polluting air-powered engine, which produces power sufficient to attain driving speeds comparable to or greater than conventional fossil fuel powered engines.

Another object of this invention is to provide such an air powered engine which makes use of an auxiliary air compressor having an auxiliary compressor to fill a compressed air supply tank up to a predetermined minimum level and as the engine consumes air from the supply tank, the auxiliary compressor is again driven for recharging the compressed air supply tank to continue to build up to a maximum predetermined air pressure level, thereby maintaining this level for smooth running operation.

SUMMARY OF THE INVENTION

It has been discovered that an internal combustion engine runs efficiently on compressed air that is supplied by air compressors. Most standard, fossil fuel burning combustion engines can be suitably converted to be powered by air pursuant to the present invention. The Wankel-type rotary engine, however, is the preferred power plant for adaptation to present invention air powered engine. The air compressors which supply the air "fuel" to the engine chamber where the air is used to provide the force for "pushing" rotors within the chamber which rotational movement turns the drive shaft, which operates through a transmission to turn the drive axle to move the vehicle. These air compressors may be electrically and/or mechanically driven.

DESCRIPTION OF THE PREFERRED EMBODIMENT(S)

The fuel system of the disclosed invention is effective for basically any internal combustion engine, including both two-stroke and four-stroke engines as well as a rotary engine, such as the familiar Wankel-type rotary engine. The compressed air used to supply the "fuel" in compressed air-powered engines of the type mentioned is supplied preferably by a bank of air compressors of either the reciprocating or screw type, depending on the application. Such powered engines may be used for: aircraft, including rotorcraft and fixed-wing aircraft; land-based vehicles, including cars, trucks, vans, motorcycles, buses, and heavy equipment; watercraft, including boats, jet skis, hydrofoils, and hovercraft; and industry applications, such as in multiple uses in factories, for pumping production wells in the oil fields, or in stores and homes to power air conditioning systems.

Compressors used to supply the compressed air to run the internal combustion engines are ideally located onboard the vehicle being powered or near the engine it is fueling. These compressors can be driven by a variety of different set up variations, either mechanical or electrical, or both. They can be driven by belts, chains, or direct drive (i. e., gears) depending on the application. Certain configurations, it is submitted, cause the engine that is being fueled to be relatively self-sustaining.

Figure 1:
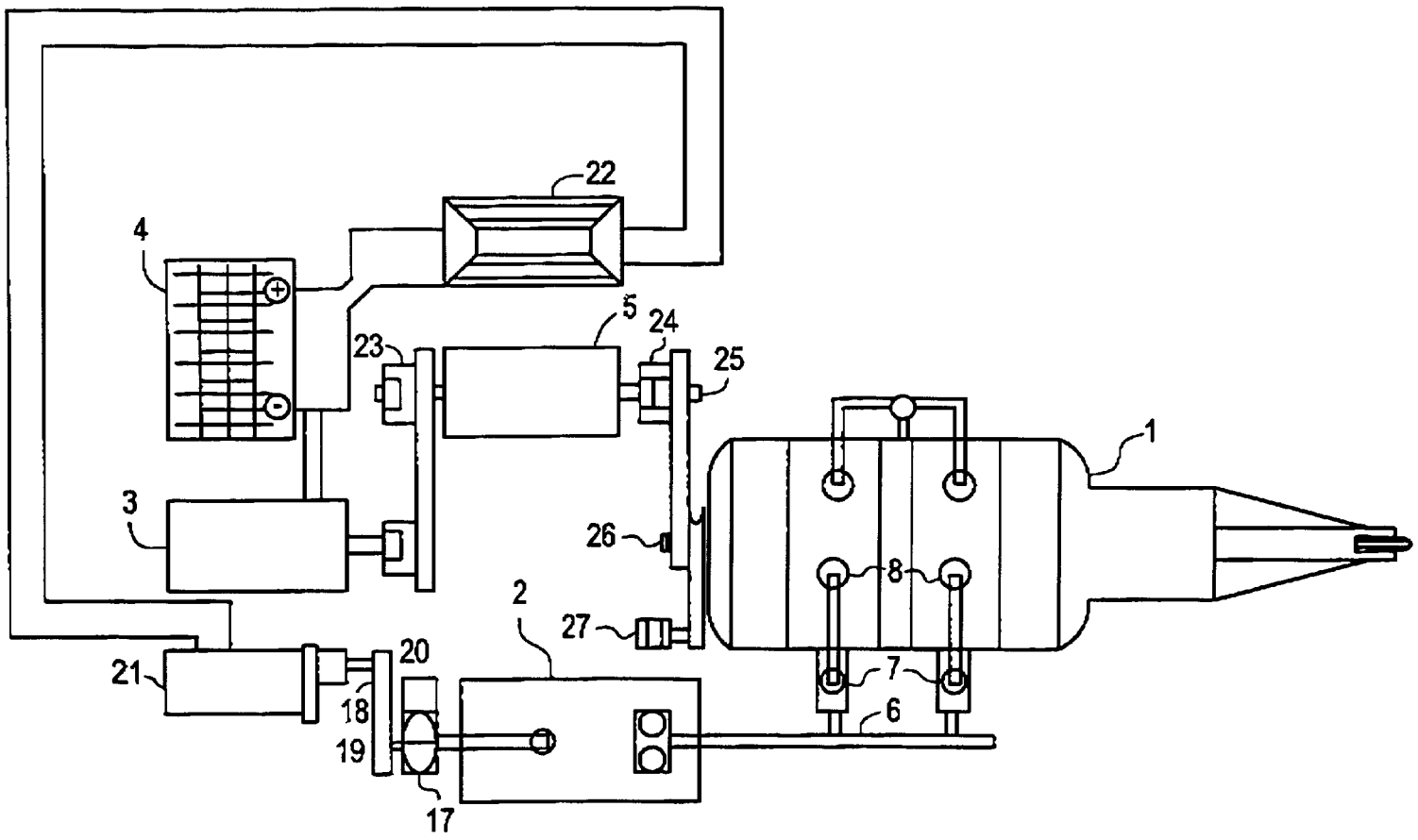
FIG. 1 is a schematic view showing the various parts of the compressed air engine and related electrical system in accordance with the present invention.
Figure 2:
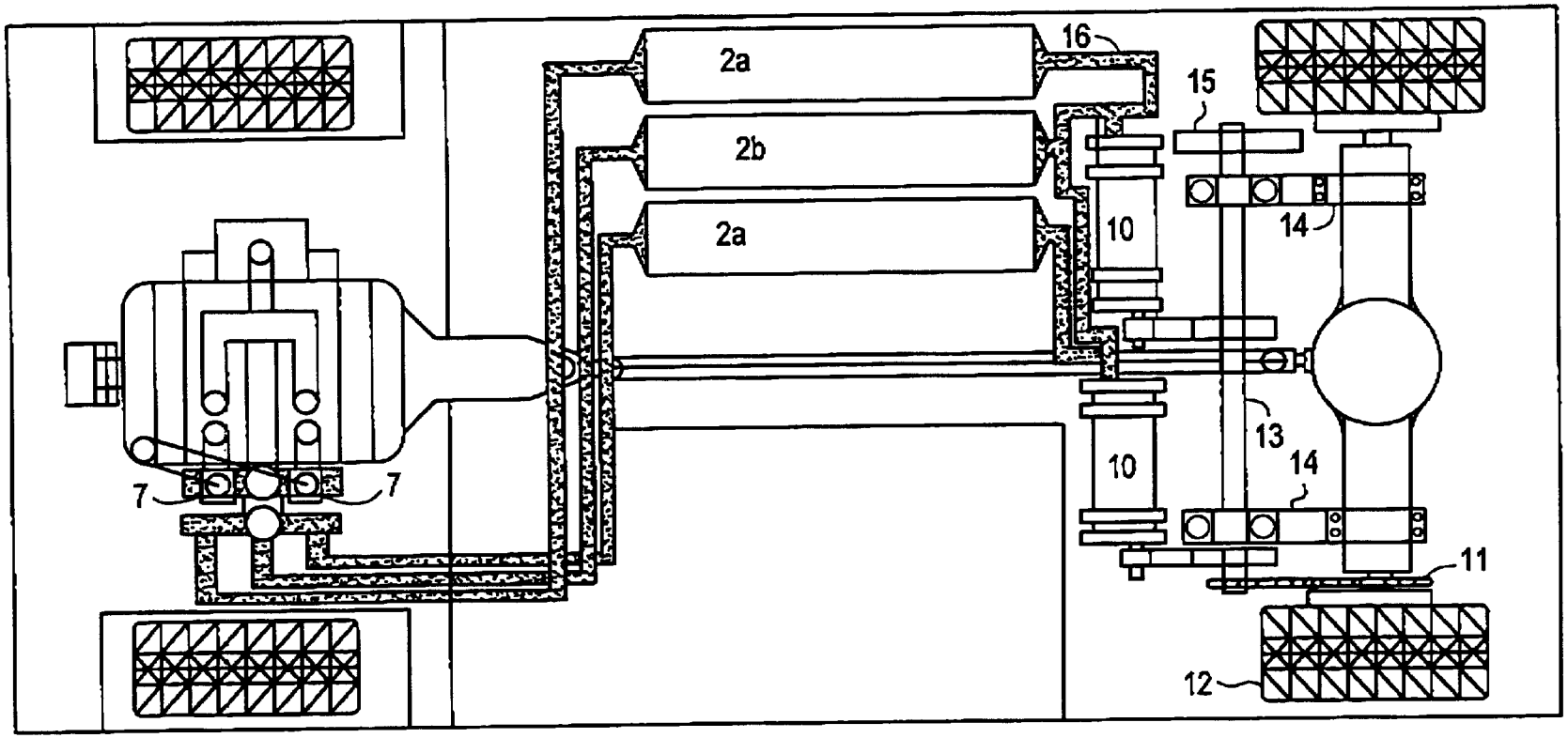
FIG. 2 is a top plan view of an alternative engine and air compressor configuration, without a related electrical system.

The invention is described herein primarily in reference to FIGS. 1 and 2.

Although any standard internal combustion engine can be adapted to serve as the basis for the invention air powered engine, FIG. 1 employs the Wankel-type rotary engine 1 as the basis for the preferred embodiment of the present invention. As disclosed herein the "fuel" for the invention air powered engine is provided by compressed air receiver and storage tanks. Primary and secondary (as backup) air receiver/storage tanks are preferably employed as the source of compressed air to power the engine. Continuing in regard to FIG. 1, at least one primary air receiver/storage tank 2 is used as part of the primary air "fuel" system. It is preferable to employ multiple primary air receiver and storage tanks of optimal size for needed on-call engine demand and vehicle configuration. An additional air storage tank, preferably 10-gallon, is preferred as an internal part of the secondary backup air fuel system. Both the primary and the secondary backup air storage systems are pre-filled to a maximum predetermined air pressure.

A preferred embodiment of the invention incorporates a Wankel-type rotary engine of the type manufactured by Mazda for its RX-7 vehicles and generally conforms to that described in U.S. Pat. No. 3,688,749 to Wankel comprising a three-lobed trochoidal peripheral engine housing, which disclosure is incorporated herein by reference. The most preferred engine for the invention compressed air-powered engine is a two-rotor Wankel rotary 12A engine. Its normal 12-volt electric starting motor 3 starts the engine, which starting motor is battery-driven 4. The battery's electric charge is maintained via a 12-volt alternator 5. The starter motor is engaged when a starter button or key is engaged, thus closing the 12-volt electrical circuitry, which in turn causes the starter motor to rotate. This rotation engages the starter motor's Bendix spring and gear assembly with the rotary engine's flywheel and gear assembly, causing the rotary engine crankshaft and multiple rotor assemblies to spin.

Once the engine is rotating, pressurized air from the primary air storage tank(s) 2 flows via high-pressure airlines into an air intake manifold 6. The pressurized air, upon entering the manifold, flows through an air pressure monitoring valve 7 and into an engine RPM throttle control valve 8, which is attached to the remaining portion of the air manifold directly connected to each of the two independent rotary engines' rotor housings. The air intake manifold 6 is attached to each of the rotary engine's housings at specific predetermined locations. The air travels through the RPM throttle control valve and throughout the remaining portion of the air manifold.

Located at the ends of the air manifold outlets are two 12-volt solenoid valves, one for each of the rotor housings. These valves are attached to the air inlets located on the rotor housings at specific points as previously stated. A modified Mazda dual-point distributor controls these 12-volt solenoid valves. The distributor is timed with the 12-volt solenoid valves to open at a predetermined specific degree of rotation of each of the engine's rotors. The 12-volt solenoid valve then stays open for a predetermined duration before the valve is closed. The timing between the 12 volt solenoid valves and the distributor is a critical part of the mechanics that allow this air-driven rotary engine to function. This action occurs on each of the rotor housings. Once rotation of the engine begins, the starter motor 3 then disengages from the engine's flywheel and gear assembly. The engine continues to run on compressed air from a primary air storage tank 2.

From this point, reference is primarily directed to FIG. 2, unless otherwise noted.

The pressure monitoring valves 7 continually read line pressure from the primary air tank's storage system. In the configuration of FIG. 2, the primary air storage system is an assembly of three 20-gallon storage tanks. Two of these tanks 2*a* are being utilized as the main source of air power to run the engine. The third tank 2*b* is activated when more air pressure is required, for example, during rapid acceleration. The air pressure-monitoring valve determines when to activate the third tank and when to shut it off. This valve also selects one primary storage tank at a time to feed the engine's air requirements.

When the pressure in the primary air storage tank drops to a predetermined minimum pressure, the air pressure monitoring valve shuts down that primary air storage tank system, and it opens the second primary air storage tank system to keep the engine in operation. This action allows the first primary air storage tank that was originally utilized to be refilled along with the possible third air storage tank, if any of its air has been used. The air replenishment system that keeps the primary air storage tanks full is a design which uses the forward momentum of the vehicle to drive an independently designed system. This independently designed system operates two rotary screw air compressors 10 which are attached to the three primary air storage tanks (2*a* and 2*b*) in a specific configuration which basically breaks the primary air supply system into two independent, but equal, compressed air fuel supplies. The forward momentum of the vehicle which drives the rotary screw type compressors 10 is harnessed by attaching one end of a gear and chain assembly 11 to the vehicle's left rear wheel 12, and the other end of the chain is attached to a live axle assembly 13 located inside the vehicle. The left rear wheel is used because in a standard differential rear end, the drive, or power, wheel of the vehicle is usually the right rear wheel, so that energy is not directly consumed from the drive wheel. The gear is attached to the left rear wheel by way of a special mounting system as the gear drives the chain, which enters the car through an opening in the car's floorboard. The chain is attached to a floating live axle assembly 13 located inside the vehicle directly above and slightly forward of the rear axle housing. This floating live axle is attached to the car's original rear axle housing by a special bracket and platform assembly 14. This attachment makes allowance for any rear wheel suspension movement and therein eliminating any interference with the live axle mounted inside the vehicle due to suspension travel. Attached to the right side of the live axle is a flywheel 15, which aids in axle rotation and enhances axle momentum. As noted, attached to this live axle by either belt or chain drives are the two rotary screw compressors 10. By way of example, compressors 10 could be 10HP Ingersoll Rand #EP20-ESP/BM, 4P984 rotary screw air compressors that will produce 35.0 CFM at 125 PSI at a variable air outflow rate. In a preferred configuration shown in FIG. 2, each of the two compressors is attached to a separate primary 20-gallon air storage tank and to the same third primary air storage tank by high-pressure airlines 16. The separate air power sources replenish the supply of air to the primary air storage system. By using the live axle compressor drive, air to run the engine is produced. (Thus, the movement powered by the air fed into the engine is used to produce more compressed air "fuel." When the vehicle is stopped after travelling a distance, the air receiver/storage (or, fuel) tanks will be as full as when the journey began.) These rotary screw type compressors 10 will also be vented with pop-off valves that may be necessary because of the high output of the compressors which will cause the storage tanks to fill very quickly. The pop-off valves can vent the excess air externally. Should the excess air be of sufficient volume and pressure, the entire system can be modified to form a closed loop air replenishment system. A pressure control valve connected to an on/off switch which would turn the compressors on/off as needed monitors compressor. This primary air supply system when added to the backup secondary air supply system will make this engine and the compressed air fuel supply system effectively self-sustaining.

The two-rotor Wankel rotary 12A engine can be started by air pressure alone, taking the 12 volt battery and starter out of the system completely. Again, the fuel that is used to cause the two rotor Wankel rotary engine to run is compressed air. Referring again to the configuration shown in FIG. 1, the compressed air is stored in a compressed air storage tank 2, which may be a 10-gallon capacity air storage tank. This 10-gallon air storage tank 2 is filled with compressed air from a 0.5 horsepower, 125 PSI reciprocating air compressor 17. This 0.5 horsepower 125 PSI reciprocating air-compressor is driven via a belt pulley system, including a belt 18, a pulley 19 on the compressor side, and a pulley on the gear reduction electric motor side 20. This belt pulley system 18–20 that is attached to the AC gear reduction electric motor 21 rated at 0.5 horsepower input will, through gear configuration produce, 1,725 RPM output (which translates to 2.5 horsepower at 1250 RPM). This AC electric gear reduction 0.5 horsepower motor 21 is being fed by an electrical inverter number PV I—NT 12OOFC 22 which is rated at 12 volt DC, 130 Amps, 230 volts, 1200 watts. This inverter is connected preferably to a 12 volt 680 Amps marine type battery 4. Also within the circuitry of the inverter and battery there is placed a 12 Volt 140 Amp alternator 5. This alternator is designed in such a way so that the drive shaft running through the armature shaft exits both sides of the alternator. Thus, producing two additional power drive sources. On the drive shaft exiting the alternator at the front will be attached an electric clutch 23. The other end of the shaft exiting the rear of the alternator an additional electric clutch 24 will be attached. However, to this clutch there will also be a V type pulley 25 attached to clutch 24. This electric clutch and pulley assembly will be directly connected to the crank shaft harmonic balancer pulley assembly 26 on the front of the Wankel Rotary Engine by way of a V type belt. The clutch assembly is wired to a 12 volt DC motor that runs at 2,350 RPMS. Attached to its output shaft there is another electric clutch 27 that is wired to clutch 23.

Figure 3A:
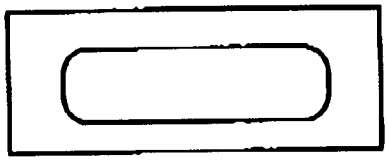
FIG. 3. is a cross-section view of a conventional Wankel-type rotary engine block.
Figure 3B:
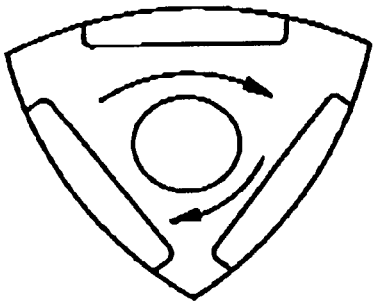

The open chamber (or, combustion chamber) is preferably modified from the stock Mazda design. It is recommended to change the internal configuration from the conventional elongated rectangle with round corners of FIG. 3, because when the spark plugs fire (a primary, or leading A, and secondary, or trailing B) B is directly above A on the rotors of a Mazda Rotary Engine.

The geometry of this combustion chamber may be improved for enhanced performance, especially with the compressed air system. When the spark plugs fire, first A then B, in a uniformly equal design combustion chamber, rotor rotation direction is compromised as the rotor rotates in a clockwise direction. Spark plug A fires as the combustion chamber passes; then, spark plug B fires in the same combustion chamber to achieve a more complete burn of the air-fuel mixture.

However, because of the rotor configuration when spark plug B fires, the rotor hesitates and tends to be pushed in a counterclockwise direction. Because of the rotor's gearing and the timing of spark plug A, the rotor continues rotating in its clockwise direction, but only because of the timing of the second rotor.

Figure 4A:
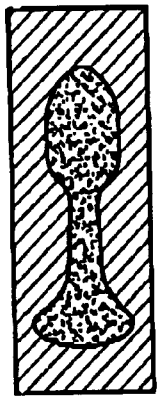
FIG. 4 is a cross-section view of a Wankel-type rotary engine block adapted to enhance the clockwise rotation of the rotors.
Figure 4B:
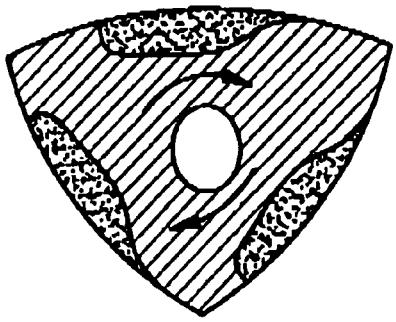

The new combustion chamber design shown in FIG. 4 enhances the clockwise rotation. By gradually building up the walls at the forward (to the direction of rotation) end of the combustion chambers and altering the geometry of the internal open space, an even greater compression effect of the compressed air is given. This results in elimination of the apparent hesitation when spark plug A fires and facilitates a faster clockwise rotation. The new and improved combustion chamber design compliments the already inherent clockwise rotation for which the engine is designed.

Many modifications and variations of the present invention will be apparent to one of ordinary skill in the art in light of the above teachings. It is therefore understood that the scope of the invention is not to be strictly confined to the literal limitations of the claims appended hereto.

What is claimed is:

1. An engine powered solely by compressed air comprising:

(a) an engine block comprising an external wall having air intake manifolds connected therewith for receiving compressed air, an internal wall defining an open chamber therein which is further defined by multiple confined areas, which are defined by the internal open chamber wall and multiple rotateably moveable elements within said open chamber, whereby the expansion of compressed air within said confined areas causes movement of said moveable elements, wherein the open chamber is trichoidal in shape and the moveable elements are rotors;

(b) a driveshaft connected to said multiple moveable elements such that movement of said elements within the internal open chamber causes said driveshaft to rotate around its linear axis;

(c) means for starting the engine;

(d) means for supplying compressed air; and (e) high pressure airlines from compressed air supply means to said air intake manifolds.

2. The engine of claim 1 wherein the compressed air supply means is a pressurized air tank.

3. The engine of claim 1 wherein the engine block is a Wankel-type rotary engine.

4. The engine of claim 3 is modified to gradually build up the walls at the forward to the direction of rotation end of the confined areas to alter the geometry of the internal open chamber.

5. The engine of claim 2 wherein the pressurized air tank is filled by a reciprocating compressor mechanically driven by an electrically powered gear reduction motor.

6. The engine of claim 1 wherein the engine starting means is compressed air.

7. The engine of claim 1 wherein the engine starting means is a 12 volt battery and a starter.

* * * * *